United States Patent [19]

Safarik

[11] Patent Number: 4,850,070

[45] Date of Patent: Jul. 25, 1989

[54] JET IMPINGEMENT HEAT EXCHANGER AND CARPET DYE BECK EMPLOYING SAID HEAT EXCHANGER

[76] Inventor: C. Robert Safarik, 15704 Gardenside La., Tampa, Fla. 33624

[21] Appl. No.: 104,299

[22] Filed: Oct. 5, 1987

Related U.S. Application Data

[63] Continuation-in-part of Ser. No. 4,741, Jan. 7, 1987, Pat. No. 4,697,291, which is a continuation of Ser. No. 719,501, Apr. 3, 1985, abandoned.

[51] Int. Cl.[4] ..... D06B 23/22

[52] U.S. Cl. ..... 8/158; 68/15; 68/183; 126/360 R; 126/391

[58] Field of Search ..... 261/DIG. 26, 124, 141; 55/95, 256; 8/151, 158; 68/15, 183; 165/908; 126/360 R, 360 A, 391

[56] References Cited

U.S. PATENT DOCUMENTS

| | | | |
|---|---|---|---|
| 1,041,188 | 10/1912 | Stewart | 126/360 R X |
| 1,246,836 | 11/1917 | Allsop et al. | 68/15 |
| 3,289,439 | 12/1966 | Hall | 68/15 |
| 3,407,805 | 10/1968 | Bougard | 126/360 A |
| 3,461,467 | 8/1969 | Duncan | 68/15 X |
| 3,593,545 | 7/1971 | Blumenkamp | 68/15 |
| 3,914,962 | 10/1975 | Doire et al. | 68/183 X |
| 4,574,745 | 3/1986 | Belles | 126/360 R X |
| 4,694,894 | 9/1987 | Kito et al. | 165/908 X |

*Primary Examiner*—Philip R. Coe

*Attorney, Agent, or Firm*—Kerkam, Stowell, Kondracki & Clarke

[57] ABSTRACT

A jet impingement heat exchanger is provided for use primarily in heating a dye solution in a dye beck for dyeing carpet, the heat exchanger being made up of a source of high temperature combustion products, an inner chamber wall having a surrounding outer chamber, the inner chamber wall having a plurality of perforations for directing jets of the hot combustion products to impoinge against the wall of the outer chamber, effecting heat transfer to the dye solution through this wall. Additionally, the invention provides for the use of a heat exchanger in combination with a submerged combustion apparatus, and methods for heating the dye solution using this combination.

10 Claims, 3 Drawing Sheets

JET IMPINGEMENT HEAT EXCHANGER AND CARPET DYE BECK EMPLOYING SAID HEAT EXCHANGER

CROSS REFERENCE TO RELATED APPLICATIONS

This application is a continuation-in-part of pending U.S. patent application Ser. No. 07/004,741, filed Jan. 7, 1987, and now Pat. No. 4,697,291, which is a continuation of U.S. patent application Ser. No. 06/719,501, filed Apr. 3, 1985, now abandoned.

BACKGROUND OF THE INVENTION

1. Field of the Invention

This invention relates to a jet impingement heat exchanger using a high temperature combustion gas, particularly for use in textile dyeing apparatus, and more particularly for use in dye becks used for dyeing carpets.

2. Description of Related Art

In a conventional commissioned carpet plant, a roll of carpet delivered to the plant for dyeing is unwound, twisted into a tow and looped over a power-driven reel disposed above the open top of a dye beck with the ends of the carpet being joined together to form an endless loop. A portion of the loop is submerged in the dye solution in the dye beck, and as the reel is driven, the carpet loop is continuously circulated through the dye solution. For effective dyeing, the dye solution needs to be heated to a temperature around 200° F., but this temperature will vary depending on the type of yarn from which the carpet is made.

Conventionally, the dye solution in a dye beck is heated by sparging live steam generated by a boiler through the solution. This method of heating the solution, however, has certain disadvantages. For example, it entails the provision, in a carpet dyeing plant, of costly, large scale steam generation equipment. Boiler size limitations limit the number of dye becks which can be supplied with steam from a single boiler, so that in large plants it may be necessary to have multiple boilers or use a single boiler alternately to supply different banks of dye becks. Moreover, heating of the dye solution by the steam sparging method is itself somewhat slow and costly, particularly in the initial preparation of the fluid which requires considerable time and energy, and this presents another disadvantage to continuous dyeing by dye solution heated by condensed steam. Thus, it takes about 6,000 pounds of steam to raise the temperature of a typical dye solution at a rate of 3 degrees per minute. Typical steam boilers in a plant with twenty dye becks make about 50,000 pounds of steam per hour, and are coal, oil or gas fired. Due to boiler limitations, most plants only make about 50,000 pounds of steam per hour, so that a maximum of only eight dye becks of a 4,000 gallon size can be heated to raise their temperatures by 3 degrees per minute.

Still another problem in sparging arrangements is that the carpet being dyed must be protected from live steam introduced into the dye solution. This is usually accomplished by use of a perforated divider wall disposed in the dye tank. While protecting the carpet, the wall inhibits circulation which is necessary for efficient dyeing.

Other methods and apparatus for heating a dye bath in a dye beck have been previously developed. An immersed heat exchange apparatus using the flame and combustion gases from a gas or oil burner to heat the bath is shown in the patent to Hall (U.S. Pat. No. 3,289,439). The heated combustion gases flow through a ducting or tubing arrangement in a flow path which is essentially parallel to the tube walls. This heat exchanger takes up a substantial amount of space in the dye beck, and has relatively low heat transfer efficiency. Because of this, it is not well suited for use in an application where space may be limited, such as in a dye beck heating system.

It is therefore an object of the present invention to provide a heat exchanger having an efficient design requiring generally smaller heat transfer surface areas for given applications.

It is another object of the present invention to provide a heat exchanger which provides improved heating of a dye solution in a textile dye bath.

It is a further object of the present invention to provide a novel method and apparatus for heating dye solution in a textile dye bath, particularly a carpet dye beck, which is more efficient and more cost-effective than the conventional steam sparging techniques, and other heating techniques.

It is a further object of the present invention to provide two-stage heating apparatus and method which employs both submerged combustion heating technology and immersion heat exchange technology.

It is a further object of the present invention to provide a heat exchanger for use in immersion heat transfer which provides more efficient heat transfer than exchangers known in the art.

Another object of the present invention is the provision of a novel form of dye beck or like dyeing apparatus which has a self-contained dye solution heating system, so as to provide, in a plant employing a number of such dye becks, elimination of steam boilers and greater flexibility of usage than in conventional plants where plural dye becks are supplied with steam from multiple boilers or a large common boiler.

SUMMARY OF THE INVENTION

The above and other objects of the present invention are accomplished by providing a jet impingement heat exchanger which is adapted to be immersed in a liquid such as a dye bath in a dye beck, and uses high temperature gas combustion products impinging against the interior surface of an outer wall of the heat exchanger to provide a means for heat transfer to a fluid contacting the exterior of the outer wall.

The heat exchanger of the present invention may be either a single, double, or multiple pass exchanger, wherein each pass comprises an inner chamber bounded by a perforated inner wall and which is in communication with a burner outlet to receive the hot combustion gas products, and an outer chamber substantially surrounding the inner chamber, the outer chamber being defined by an outer wall which has an exterior surface which is in contact with the fluid to be heated.

The jet impingement action of the hot combustion products against the interior surface of the outer wall in the heat exchanger results in a more efficient heat transfer than that of other known heat exchangers. As used herein, the term "jet impingement" describes the flow of the hot gas combustion products directed from the inner chamber to impact against the interior surface of the outer chamber. The inner chamber receives the hot gas combustion products from the burner, which are forced through an opening or duct leading to the inner chamber. The inner chamber has a plurality of perforations through its surface, and the hot combustion gas is released and directed through these openings in such a manner that the gases will impinge against the interior surface of the outer wall at a predetermined velocity. The impingement of the gases against the wall raises the heat transfer drastically in the areas where impingement occurs, yielding a higher efficiency unit than other immersion heat exchangers. These gases then exit the outer chamber into either a second pass of the heat exchanger or to a duct leading to a stack through an opening in the outer wall of the outer chamber.

When used in a conventional form of carpet dye beck, for example, the jet impingement heat exchanger may be used by itself or in conjunction with a submerged combustion apparatus, such as the one which is the subject of the parent application, to provide a two-stage heating apparatus and method for use in heating a dye solution. A two-stage heating method and associated apparatus is desirable in some instances because although the jet impingement heat exchanger of the present invention is generally more efficient than other known heat exchangers, it has been seen that at lower temperatures, the submerged combustion process is a more efficient heating method and further provides a desirable turbulence in the bath which would not otherwise be present in a lower temperature bath being heated by either the jet impingement heat exchanger or another heat exchanger. The jet impingement heat exchanger is, however, more efficient than a submerged combustion heater at higher temperatures, and at the higher temperatures the bath provides its own turbulence through the commencement of boiling.

In such a two-stage heating method and apparatus, a first stage for heating a dye solution from ambient temperature would employ high temperature combustion products which are discharged directly into the dye solution in a manner whereby the combustion products are bubbled through the dye solution accompanied by heat exchange between the bubbled combustion products and the dye solution. More particularly, in accordance with the two-stage heating method, pressurized, high temperature gas combustion products are generated by a submerged combustion heating apparatus associated directly with the dye bath which directs a flame into a distribution manifold submerge in the dye solution.

A submerged combustion heater may be used to generate pressurized gas at about 2,000° F. which, when introduced directly to the dye bath, bubbles through the dye bath and transfers substantially all or a good bit of its heat to the dye solution, emerging from the surface of the dye bath at substantially ambient temperature or a slightly higher temperature. Further, the process is accompanied by significant agitation or turbulence of the heated dye solution within the tank which further enhances the dyeing process.

The first stage heating apparatus in accordance with the invention may comprise a combustion chamber external to one wall of the dye beck, and a hot gas distribution manifold extending from the chamber through the dye beck wall substantially across the width of the dye beck adjacent the base thereof. The distribution manifold may have a longitudinal series of discharge orifices or slits. A conventional form of submerged combustion burner assembly may be located atop the combustion chamber, the arrangement being such that when the burner is idle, dye solution from the dye beck fills the manifold and the combustion chamber through the gas discharge orifices or slits. This fluid is displaced by pressurized products of combustion when the burner is operative, while the heated products of combustion issue from the discharge orifices and bubble through the dye solution in the dye beck. The configuration of the manifold and the discharge orifices which may comprise a series of discrete openings or a single slit, or multiple lengthwise slits, is preferably such as to equalize the gas pressure across the width of the dye beck so as to provide substantially uniform bubbling of heated liquid through the dye solution across the width of the beck. The uniformity of heat distribution across the beck thus produced, promotes the possibility of dyeing carpet in an open-width configuration rather than in tow form.

The first stage combustion chamber may be surrounded by a heat transfer chamber, which may be air cooled, or which may communicate with the interior of the dye beck through a wall opening in the beck, so that the dye solution circulates through the heat transfer chamber in direct heat transfer relation with the combustion chamber. The walls of the combustion chamber may have fins to further enhance heat transfer to the dye solution.

The second stage of the two-stage heating apparatus and method uses a jet impingement heat exchanger. In a preferred embodiment of the invention, the second stage jet impingement heat exchanger is activated at a preset dye solution temperature measured in the dye bath, and the first stage apparatus is deactivated. A second burner assembly identical to that used to provide hot combustion gas to the submerged combustion manifold may be used to provide hot combustion gas to the inner chamber of the jet impingement heat exchanger. Instead of the combustion products being directed into a gas distribution manifold for discharging the hot gas directly into the dye bath in the first stage submerged combustion, the combustion products ar directed through an opening between the burner assembly chamber and the inner chamber of the jet impingement heat exchanger. The hot combustion products are directed through perforations in the inner chamber to impinge on the interior surface of the wall of an outer chamber surrounding the inner chamber, and the dye solution is heated through contact with the exterior of the outer chamber. The dye bath may be heated in such a manner until it reaches a rolling boil (if desired).

BRIEF DESCRIPTION OF THE DRAWINGS

These and other features of the present and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout the several views.

DESCRIPTION OF THE PREFERRED EMBODIMENTS

Figure 1:
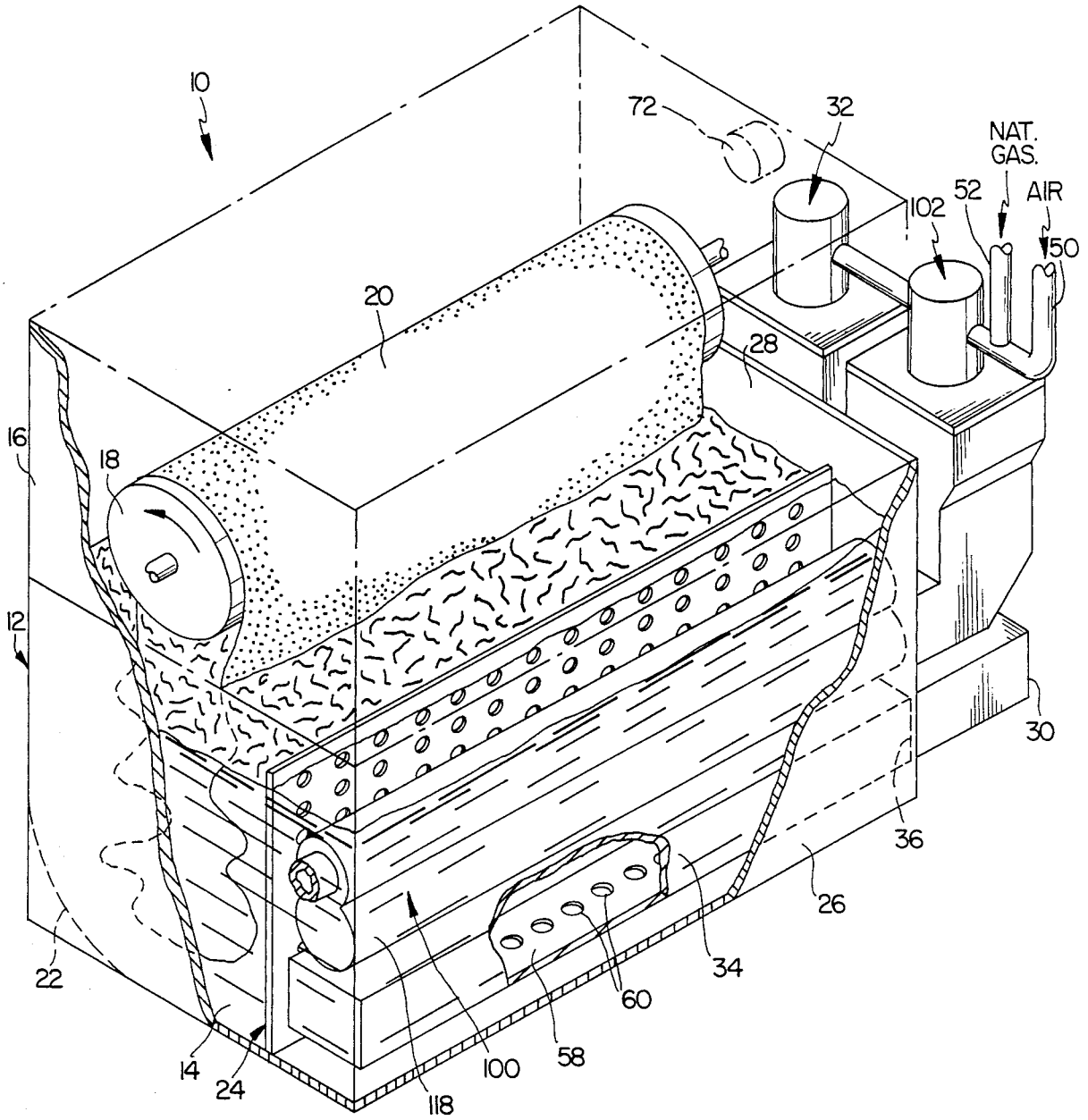
FIG. 1 is a perspective view, partially broken away, of a carpet dye beck having a two-stage heating apparatus and method according to the present invention.

Referring initially to FIG. 1 there is illustrated a carpet dye beck, generally indicated by reference numeral 10, of the general type used in a commissioned carpet plant, but which is provided with a novel and improved heating system in accordance with the invention as described below.

Dye beck 10 has a tank portion 12 of generally conventional construction, for receipt of a dye solution 14. A cover portion 16 of the dye beck, which is also of generally conventional form, is provided, in known manner, with a driven main reel 18 for receipt of an endless carpet loop 20 to be dyed, whereby the carpet is continuously circulated through the dye solution by rotation of the reel. It may here be noted that carpet loop 20 is shown in FIG. 1 as being spread substantially uniformly along the length of the reel 18, rather than being twisted into a tow, however, the apparatus can, if desired, be used with the carpet in twisted, tow-like configuration on reel 18. Tank portion 12 of the dye beck has a curved internal base wall 22 of conventional form, and may include an optional perforated distribution baffle 24 adjacent front wall 26 also in a known manner.

Figure 2:
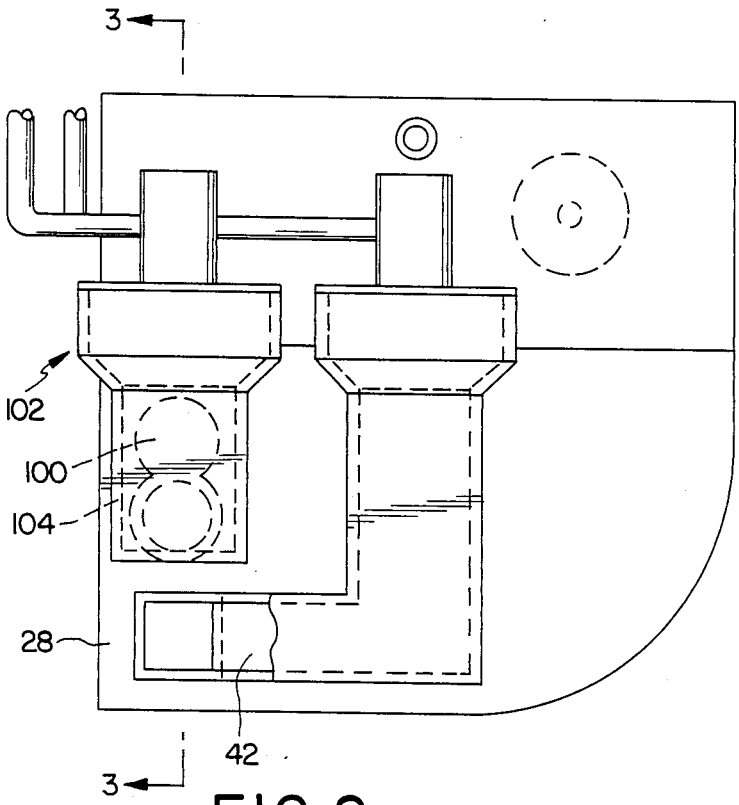
FIG. 2 is an end elevation view of the carpet dye beck.
Figure 3:
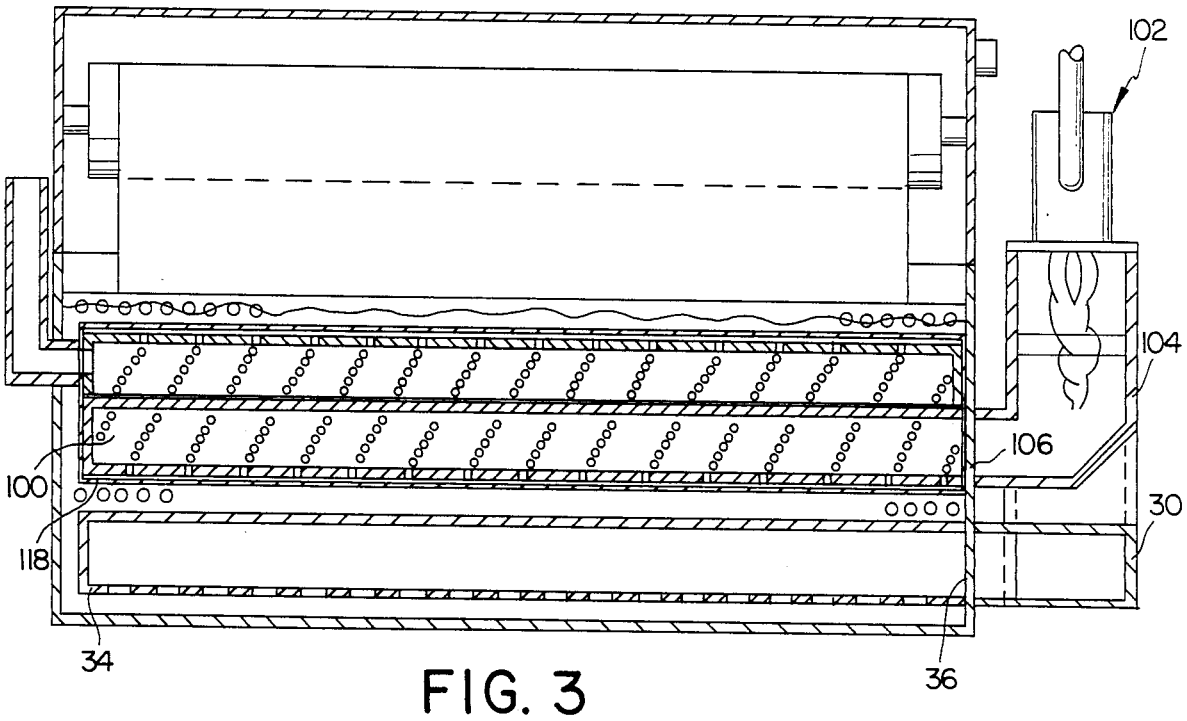
FIG. 3 is a front sectional view of the dye beck taken along line 3—3 of FIG. 2.

The dye solution must be heated in order that effective dyeing of the carpet can take place. The temperature of the dye solution would have to be raised, for example, to about 190° F. for nylon carpet, and about 210° F. for polyester carpet. A preferred means for heating the dye solution is shown in FIGS. 1–3 as what will be termed a two-stage method and apparatus for performing the method.

It should be recognized, even though the apparatus and method to be described will be discussed as a first and second stage of a two-stage heating process and apparatus, that either the first or second stage apparatus can be installed and used as a heating apparatus without the other being present. Individually, the submerged combustion heater, which is the subject of patent application Ser. No. 004,741, filed Jan. 7, 1987, and the immersed jet impingement heat exchanger, are each very efficient heating devices. The combination of the two allows the overall efficiency of heating a large bath of liquid to be improved, as the submerged combustion apparatus is generally more efficient at lower temperatures and the jet impingement heat exchanger is generally more efficient at the higher temperatures for the dyeing of carpet. Thus, it is envisioned that the submerged combustion apparatus will be employed when the dye solution is being heated from ambient temperatures up to approximately 140° –170° F., and the jet impingement heat exchanger will be employed above those temperatures. A preferred mode of operation involves selecting a predetermined temperature at which a switchover from one apparatus to the other will occur.

In a preferred embodiment, the first stage heating is provided by a submerged combustion heating apparatus. The submerged combustion heating apparatus includes a casing assembly 30 disposed on the outside of side wall 28 of tank portion 12 of the dye beck, a burner assembly 32 atop the casing 30, and elongate gas distribution manifold 34 extending from casing 30 into the dye beck through an opening 36 in wall 28. Distribution manifold 34 extends into the dye beck from the base of the combustion chamber.

Burner assembly 32 may comprise a commercially available gas-fired submerged combustion burner unit, such as a unit of the type supplied by Hauck Manufacturing Co. of Lebanon, Pa. with gaskets and fittings adapting the unit to casing 30 and to suitable air and gas input pipes 50, 52 connected to a pressurized air source (for example from an air blower) and a source of gaseous fuel, and threaded connections for access parts permitting use of the unit against a back pressure of about 3 psig. A burner unit of this nature for example is designed so that the hydrostatic back pressure in the system will not cause variations in the air fuel ration. Burner units of this nature are effective to heat the pressurized air up to temperatures of the order of 2000° F.

Distribution manifold 34 extends from the base of combustion chamber 42 along the full length of the dye beck adjacent front wall 26, somewhat above but close to the base of the beck. The manifold is specifically designed to provide an even internal hydrostatic pressure across the width of the dye beck so that the heated gases are discharged into the dye beck with an even pressure distribution lengthwise of the manifold to effect bubbling of the heated gas through the dye solution and substantially evenly distributed heating across the width of the dye beck. To this end, base wall 58 may be provided with a series of gas discharge orifices 60 of like size, substantially evenly spaced along the length of the manifold. Alternatively, the orifices may be replaced by elongate discharge slits (not shown). A single discharge slit may also be used. In another non-illustrated embodiment, an even gas pressure distribution along the dye beck is obtained with a distribution manifold of constant cross section along its length, but having discharge orifices of varying size along the length of the manifold. The orifices may, for example, be arranged in successive series, with each series being of different diameter.

When the burner is idle, prior to commencement of the heating process, dye solution will back-up through the discharge orifices 60 (or slits) and fill the manifold 34 and combustion chamber 42. On start up, an air nozzle of the burner unit is first operated on its own prior to ignition of the burner in order to displace the backed up dye solution, the burner gas nozzle is then opened, and the burner ignited in accordance with conventional submerged combustion practice. The submerged combustion burner unit produces a high energy flame. The products of combustion providing a heated gas typically at a temperature of about 2,000° F. which discharges into the dye solution through the base of discharge manifold 34 providing substantially uniform bubbling of the heated gas across the width of the dye beck, accompanied by turbulent agitation of the dye solution at all temperatures producing a churning level or foam layer. At the top the layer may be about 8 to 10 inches at the top of the dye solution at temperatures in the 100° F. to 170° F. range. A churning level or foam layer of about 12 to 14 inches may be provided at higher temperatures. The churning or foaming characteristic of the invention may be enhanced by including a defoaming agent or defoaming agents in the dye solution. While agitation of the dye solution may be considered beneficial to effective dyeing, distribution baffle 24 is used optionally in applications where reduced agitation is desired, and has the additional effect of enhancing the lateral distribution of heat through the dye bath. The spent products of combustion which issue from the surface of the dye solution may, for example be exhausted from the dye beck through a vent opening 72.

According to this preferred embodiment, when the dye solution reaches a predetermined switchover temperature in the dyeing process, the first stage heating provided by the submerged combustion apparatus is deactivated by shutting down the burner. A second stage of the heating apparatus and method according to a preferred embodiment of the present invention is then activated. It may also be preferred to have both stages activated for a short period of time to allow the second stage to come up to full operation before the first stage is shut down.

Figure 5:
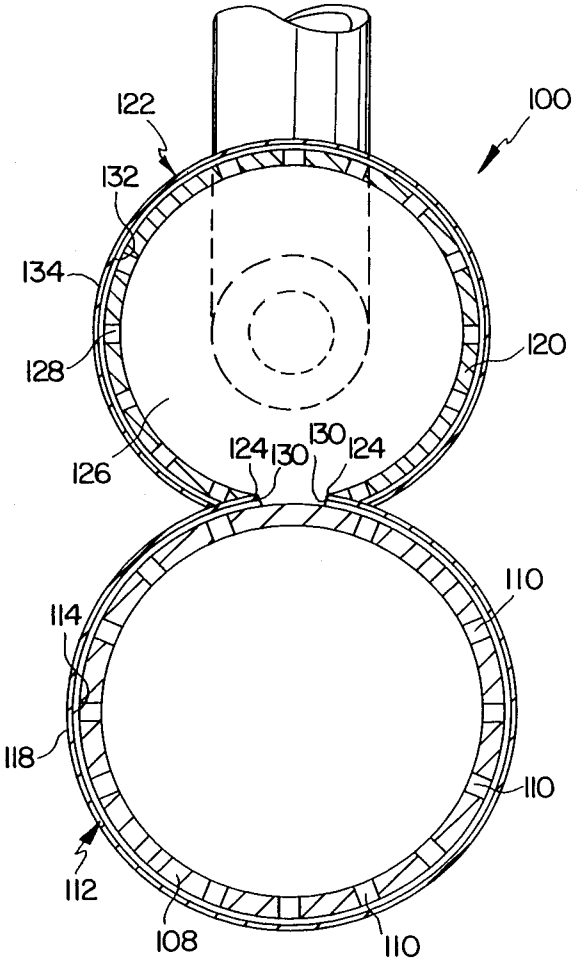
FIG. 5 is an end sectional view taken along line 5—5 of FIG. 4.
Figure 4:
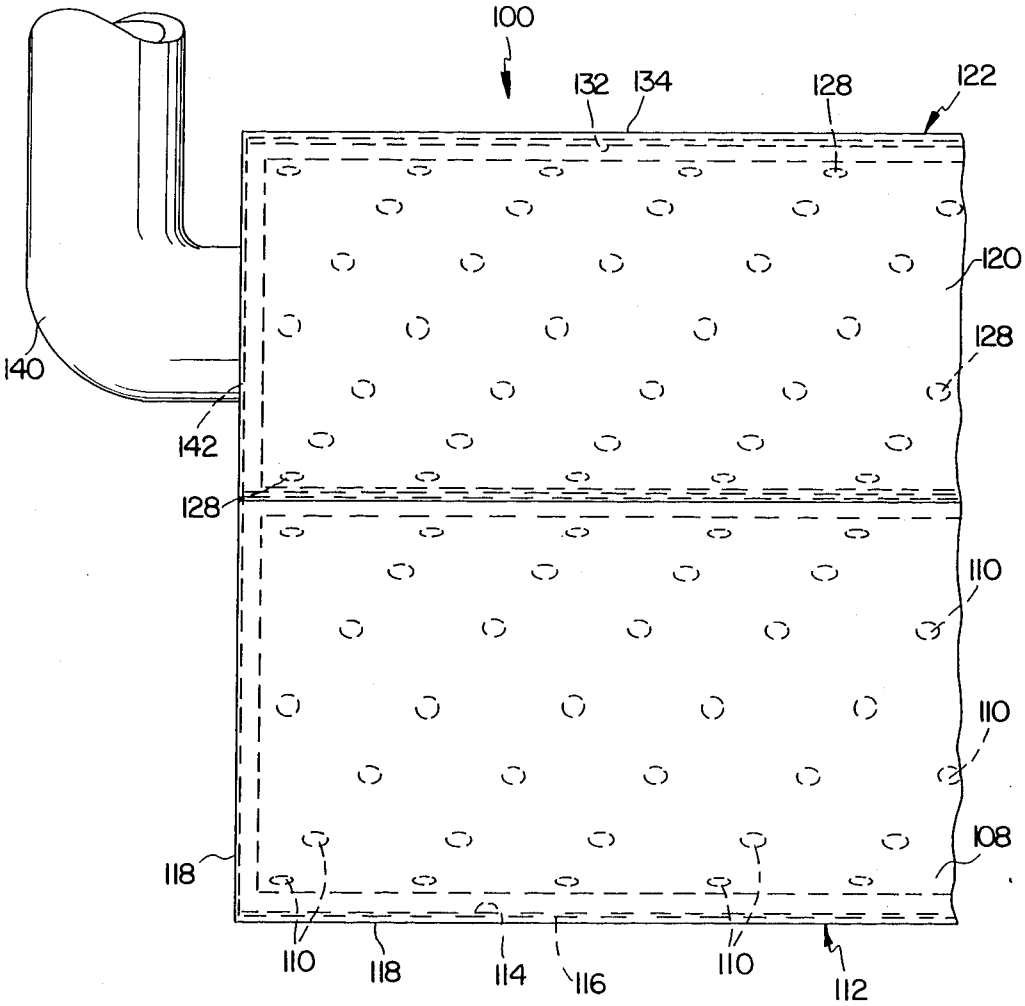
FIG. 4 is a front partial sectional view of the jet impingement heat exchanger part of the heating apparatus.

Referring primarily now to FIGS. 3, 4 and 5, the second stage according to a preferred embodiment of the present invention comprises a jet impingement heat exchanger, referred to generally by numeral 100. Burner assembly 102 is provided for this second stage as a means for producing a pressurized high temperature stream of combustion products. Burner assembly 102 (with the exception of ducting) is preferably identical in construction to burner assembly 32 used in the first stage and is intended to be installed in a similar manner. The burners may be mounted side-by-side on the outside of side wall 28 as shown, with ducting provided as necessary to connect the burner chambers with the associated first and second stage heaters. An alternative embodiment, not illustrated, would place burner assemblies 32, 102 at the opposite side walls of the dye beck.

Burner assembly 102 has a surrounding casing 104 which is in communication with the heat exchanger 100 through duct opening 106. The hot combustion products are forced by the continuing supply of pressurized air to flow out of casing 104 through duct opening 106 into an end of an elongated, generally cylindrical, inner plenum chamber 108 of the heat exchanger 100. Inner chamber 108 is defined by a wall having a plurality of perforations 110 disposed along substantially the entire length of the inner chamber 108. Inner chamber 108 can be alternately described as comprising a barrier means having a plurality of perforations along its longitudinal extent.

Inner chamber 108 is substantially surrounded by an associated outer chamber 112, the outer chamber 112 in this preferred embodiment also having an elongated, generally cylindrical shape such that approximately equal spacing can be attained between the inner chamber 108 and the outer chamber 112 around the circumference of the chambers. Stated another way, two generally cylindrical chambers are provided, the outer chamber 112 having a radius which is larger by a predetermined amount than the radius of the inner chamber 108, and the chambers are disposed along a common longitudinal axis. The outer chamber 112 preferably spans substantially the entire width of the dye beck, which will ensure substantially even heating across the entire width of the dye bath.

While the preferred embodiment is described as having cylindrical chambers, other shapes are contemplated, including elongated "boxes" of square or rectangular cross-sections. Therefore, any references to cylinders and also to "diameters" of cylinders should also be interpreted to include other shapes and, instead of "diameters", equivalent cross-sectional dimensions of those shapes.

The hot combustion products which are forced into inner chamber 108 are further discharged through perforations 110, taking the form of air jets, to impinge against the interior side 114 of the wall 116 comprising outer chamber 112. The heat transfer is effected in this jet impingement heat exchanger 100 through wall 116 of outer chamber 112, the exterior side 118 of which is in contact with the dye bath to be heated.

As depicted in the several Figures, in this preferred embodiment, a two-pass heat exchanger is provided. Thus, the previously described inner chamber 108 and associated outer chamber 112 will be considered as comprising a first inner chamber and a first outer chamber of a first pass of the heat exchanger 100. A second pass of the heat exchanger 100 is made up of a second inner chamber 120 and associated second outer chamber 122 whose radial dimensions are preferably less than and, at most, equal to the radial dimensions of the first pass inner and outer chambers, respectively. The second pass (and subsequent passes if more than two are provided) allow the exchanger to recover additional heat from the hot combustion products. In the two-pass heat exchanger shown, the second pass components are disposed above the first pass components in a stacked relation.

At a top portion of first outer chamber 112, a slot 130 is provided which preferably extends substantially the entire length of the chamber. The second inner chamber 120 is provided with corresponding longitudinal opening 124 at its lower side, and the second inner chamber is joined to the first outer chamber in a manner such that the slot 130 and opening 124 provide a passageway for the hot combustion products to flow from the space between the first inner and outer chambers into the interior 126 of second inner chamber 120. The second outer chamber 122 surrounds the second inner chamber and is spaced apart therefrom at a predetermined distance. The second outer chamber 122 will have a larger longitudinal opening than the second inner chamber 120 and will be joined to the exterior wall 118 of first outer chamber 112 along the longitudinal extent of the two chambers.

The operation of the second pass in providing further heat transfer begins with the hot combustion gases which have already been forced through perforations 110 to impinge on the interior surface 114 of first outer chamber 112. The hot combustion products, in addition to having a natural tendency to rise, are forced out of the space between the first inner and outer chambers by fresh hot combustion products entering the space through perforations 110. The combustion products rise and pass through slot 130 and opening 124 into the second inner chamber 120. Inner chamber 120 has a plurality of perforations 128 disposed along substantially its entire longitudinal extent, much in the same manner as the perforations 110 of the first inner chamber 108. These combustion products are then forced through perforations 128 to impinge on the interior surface 132 of the wall comprising the second outer chamber 122. Heat transfer in this pass, like that in the first pass, is effected through the wall of outer chamber 122, whose exterior surface 134 is immersed in and in contact with the dye solution.

As shown, the second pass is the final pass of the heat exchanger 100. Therefore, a means is provided for venting the hot combustion products after they have been forced through perforations 128 and have impinged against the wall of the second outer chamber 122 to give up heat to the wall. This means is shown in the preferred embodiment as a duct 140, in communication with an opening 142 at an end of the second outer chamber 122. The combustion products at this stage are not likely to have any useful heat remaining, and duct 140 may be extended to make an exhaust stack or may be connected to a plant exhaust system.

There are several design parameters which can be varied within the scope of the present invention in optimizing the cost and efficiency of the jet impingement heat exchanger 100 for a specific application. For example, a one-pass heat exchanger may be employed where the additional cost of a second pass will not be paid back in energy costs by the additional recovery of heat provided by the second pass. Conversely, the heat exchanger may have more than two passes if there is a sufficient amount of undissipated heat in the combustion products after two passes to make a third (fourth, etc.) pass cost effective.

Another design consideration is the amount of space available for the heat exchanger. This will dictate, in some cases, the maximum size of a single pass and possibly also the overall maximum size of the exchanger. Because the outside chamber wall is the heat transfer surface as well as the structure defining the overall exterior size of the heat exchanger, changes in the size of a pass of the heat exchanger will vary the amount of heat transfer surface available. Thus, in an application where there is a restrictive width limitation but a less restrictive weight limitation, a stacked, two-pass heat exchanger having smaller outer chambers may be used in place of a single pass heat exchanger having a larger outer chamber, to provide adequate heat transfer surface.

In general, where two or more passes are used, the second and subsequent passes will each preferably be smaller in diameter than the pass preceding it. Less heat transfer surface area will be required because there will be less heat in the combustion products to be transferred into the dye solution. Additionally, the gases will be less expanded because it is lower in temperature, and using smaller chambers will tend to maintain the pressure in the system.

As stated previously, it is the impingement of the combustion products against the interior surface 114 of the outer chamber 112 that creates the improved heat transfer efficiency of the heat exchanger 100 of the present invention. The perforations are preferably disposed and oriented in a manner such that the hot combustion products will be directed out of each perforation to impinge against the outer chamber substantially perpendicularly to the interior surface 114. Other design details pertaining to the arrangement and size of the perforations, as well as the spacing between the inner and outer chambers of each pass may be varied in order to attain desired performance characteristics.

In the preferred embodiment, for example, the perforations 110, 128 (see FIG. 4) are disposed in horizontal rows, the perforations being spaced apart from one another and extending substantially along the longitudinal extent of the respective inner chambers. However, instead of placing the perforations in each horizontal row directly above and below (in vertical alignment) the perforations in adjacent rows, the perforations 110, 128 of each row are staggered or offset vertically from the rows immediately above and below. The use of this pattern avoids or minimizes a problem referred to as "downwash" in the hot combustion products as the begin to rise after having impinged against the wall of the outer chamber. If the perforations are vertically aligned or otherwise too closely spaced, the gases would quickly encounter turbulence from the combustion products being forced out of the perforation immediately above or adjacent thereto. This turbulence or "downwash" is minimized by the offset of the perforations, which provides a more unobstructed path for the gases to rise or exit the space between inner and outer chambers.

The preferred size and spacing of the perforations, and the preferred spacing between the inner and outer chambers may depend on the characteristics of the burner and the amount of pressure the gas stream will generate initially. Also, the amount of heat transfer required for the particular application will play a role in making these design determinations.

As previously mentioned, but not shown in any of the Figures, it is envisioned that the heat exchanger chambers may be constructed in shapes other than cylindrical. For example, square or rectangular cross-sectional shape can be used if the circumstances make one of those shapes preferable to a circular cross-section.

The foregoing description includes various details and particular structures according to the preferred embodiment of the invention, however, it is to be understood that these are for illustrative purposes only. Various modifications and adaptations will become apparent to those of ordinary skill in the art. Accordingly, the scope of the present invention is to be determined by reference to the appended claims.

What is claimed is:

1. A textile dyeing apparatus comprising:

container means defining a dye bath section for containing a dye solution, and means for heating a dye solution to be contained therein comprising:

means for generating a pressurized high temperature stream of gas by burning fuel in a flow of pressurized air;

a heat exchanger extending across approximately an entire width of said dye bath section and adapted to be immersed in a die solution to be contained by said dye bath, said heat exchanger having at least a first pass, wherein said first pass comprises:

a first inner chamber so constructed and arranged that said pressurized high temperature stream of gas is received through an opening in an end of said first inner chamber and said pressurized stream of gas is discharged through a plurality of spaced perforations disposed along substantially an entire length of said first inner chamber; and an associated first outer chamber spaced apart from and substantially surrounding said first inner chamber, said first outer chamber being defined by a wall having an interior surface and an exterior surface, wherein a plurality of jets of pressurized high temperature gas discharged through said perforations of said first inner chamber impinge on said interior surface of said first outer chamber and wherein said exterior surface of said wall is adapted to perform as a heat transfer surface when dye solution is contacted with said surface; and said textile dyeing apparatus further comprising a submerged combustion heating means for generating a second pressurized high temperature stream of gas and for discharging said second gas into said dye bath.

2. A textile dyeing apparatus as defined in claim 1 wherein the inner and outer chambers are so constructed and arranged that said jets of pressurized high temperature gas discharged through said perforations of said first inner chamber impinge on said interior surface of said first outer chamber at approximately a perpendicular orientation.

3. A textile dyeing apparatus as defined in claim 2 wherein said first outer chamber of said heat exchanger has an exhaust means for collecting and removing said pressurized gas from the space between said first outer chamber and said first inner chamber after said gas has been discharged into said first outer chamber from said first inner chamber.

4. A textile dyeing apparatus as defined in claim 3, further comprising a plurality of successive passes, each of said successive passes comprising an inner chamber so constructed and arranged that said pressurized gas collected and removed from an outer chamber of an immediately preceding pass is discharged into an interior of said inner chamber, and said pressurized gas is discharged through a plurality of spaced perforations disposed along substantially an entire length of said inner chamber, and said inner chamber of each successive pass having an associated outer chamber spaced apart from and substantially surrounding said inner chamber, said associated outer chamber having a wall which has an interior surface and an exterior surface, wherein jets of pressurized gas discharged through said perforations of said inner chamber impinge on said interior surface of said outer chamber wall and said exterior surface of said outer chamber wall is adapted to perform as a heat transfer surface when a dye solution is contacted with said surface.

5. A textile dyeing apparatus as defined in claim 1 wherein said submerged combustion heating means operates as a first stage heating apparatus and said heat exchanger operates as a second stage heating apparatus.

6. A textile dyeing apparatus as defined in claim 1 wherein said first inner chamber and said associated first outer chamber are substantially cylindrical in shape.

7. A method of heating a dye solution in a dye bath to a temperature effective for use in dyeing a textile article and the like placed in the dye solution, said method comprising:

(a) in a first stage:

(i) generating a first pressurized high temperature stream of gas by burning fuel in a flow of pressurized air, and (ii) discharging the first high temperature stream of gas into the dye solution in a manner providing bubbling of the gas through the dye solution accompanied by heat transfer between the gas and the dye solution; and (b) in a second stage:

(i) generating a second pressurized high temperature stream of gas by burning fuel in a flow of pressurized air, (ii) discharging the second high temperature stream of gas into a first inner chamber of a heat exchanger, said heat exchanger being immersed in said dye solution, (iii) further discharging the high temperature gas through perforations in a surface of said first inner chamber to impinge against an interior surface of a first wall of a first outer chamber whereby heat transfer is effected through said first wall from said gas to said dye solution, and (iv) collecting and removing the gas from said first outer chamber after said gas has contacted said first wall.

8. A method of heating a dye solution as defined claim 7 further comprising the steps of:

(c) selecting a predetermined switchover temperature of said dye solution;

(d) monitoring an actual temperature of said dye solution;

wherein the step of generating said first pressurized high temperature stream of gas in said first stage is performed when said actual temperature of said dye solution is equal to or less than said predetermined switchover temperature;

and wherein the step of generating said second pressurized high temperature stream of gas in said second stage is performed when said actual temperature of said dye solution is equal to or greater than said predetermined switchover temperature.

9. A method of heating a dye solution as defined in claim 8, wherein said second stage comprises the further steps of:

(vi) discharging the gas from said first outer chamber into a second inner chamber of said heat exchanger (vii) further discharging the gas through perforations in a surface of said second inner chamber to impinge against an interior surface of a second wall of a second outer chamber whereby heat transfer is effected through said second wall from said gas to said dye solution, and (viii) collecting and removing the gas from said second outer chamber after said gas has contacted said second wall.

10. A method of heating a dye solution as defined in claim 7, wherein said perforations are disposed to discharge the second high temperature stream of gas to impinge against said interior surface in a substantially perpendicular manner.

* * * * *

UNITED STATES PATENT AND TRADEMARK OFFICE

CERTIFICATE OF CORRECTION

PATENT NO. : 4,850,070

DATED : July 25, 1989

INVENTOR(S) : SAFARIK, C.Robert

It is certified that error appears in the above-identified patent and that said Letters Patent is hereby corrected as shown below:

In Abstract, line 8, "impoinge" should be --impinge--.

In Col. 10, Claim 1, line 40, "die" should be --dye--.

Signed and Sealed this

Twenty-ninth Day of May, 1990

*Attest:*

HARRY F. MANBECK, JR.

*Attesting Officer*

*Commissioner of Patents and Trademarks*